US005582632A

United States Patent [19]

Nohr et al.

[11] Patent Number: 5,582,632

[45] Date of Patent: Dec. 10, 1996

[54] CORONA-ASSISTED ELECTROSTATIC FILTRATION APPARATUS AND METHOD

[75] Inventors: Ronald S. Nohr, Roswell; John G. MacDonald, Decatur, both of Ga.

[73] Assignee: Kimberly-Clark Corporation, Neenah, Wis.

[21] Appl. No.: 241,100

[22] Filed: May 11, 1994

[51] Int. Cl.[6] ..... B03C 3/60

[52] U.S. Cl. ..... 95/78; 55/524; 55/528; 55/DIG. 5; 55/DIG. 39; 96/66; 96/69; 96/96; 96/99

[58] Field of Search ..... 55/524, 527, 528, 55/DIG. 5, DIG. 39; 96/66, 68, 69, 96, 98, 99; 95/59, 69, 70, 78; 264/DIG. 8, DIG. 48; 428/263, 389, 221, 224

[56] References Cited

U.S. PATENT DOCUMENTS

| | | | |
|---|---|---|---|
| 3,016,599 | 1/1962 | Perry, Jr. | 428/338 |
| 3,341,394 | 9/1967 | Kinney | 428/292 |
| 3,487,610 | 1/1970 | Brown et al. | 96/69 |
| 3,655,862 | 4/1972 | Dorschner et al. | 264/555 |
| 3,692,618 | 9/1972 | Dorschner et al. | 156/167 X |
| 3,704,198 | 11/1972 | Prentice | 428/198 |
| 3,705,068 | 12/1972 | Dobo et al. | 156/167 X |
| 3,755,527 | 8/1973 | Keller et al. | 156/167 X |
| 3,798,879 | 3/1974 | Schmidt-Burbach et al. | 55/527 X |
| 3,802,817 | 4/1974 | Matsuki et al. | 425/66 |
| 3,849,241 | 11/1974 | Butin et al. | 264/121 X |
| 3,853,651 | 12/1974 | Porte | 156/73.6 |
| 3,978,185 | 8/1976 | Buntin et al. | 264/121 X |
| 4,064,605 | 12/1977 | Akiyama et al. | 425/66 X |
| 4,091,140 | 5/1978 | Harmon | 156/244.22 X |
| 4,100,319 | 7/1978 | Schwartz | 156/290 X |
| 4,100,324 | 7/1978 | Anderson et al. | 156/62.2 X |
| 4,118,531 | 10/1978 | Hauser | 428/224 |
| 4,185,972 | 1/1980 | Nitta et al. | 55/528 X |
| 4,323,374 | 4/1982 | Shinagawa et al. | 55/DIG. 39 |
| 4,340,563 | 7/1982 | Appel et al. | 264/518 |
| 4,360,563 | 11/1982 | Stengle | 428/323 |
| 4,405,297 | 9/1983 | Appel et al. | 425/66 X |
| 4,434,204 | 2/1984 | Hartman et al. | 428/198 |
| 4,627,811 | 12/1986 | Greiser et al. | 425/377 X |
| 4,644,045 | 2/1987 | Fowells | 264/210.8 X |
| 4,652,281 | 3/1987 | Masuda et al. | 96/69 |
| 4,663,220 | 5/1987 | Wisneski et al. | 428/221 |
| 4,886,527 | 12/1989 | Fottinger et al. | 55/DIG. 39 |
| 4,917,942 | 4/1990 | Winters | 55/DIG. 39 |

FOREIGN PATENT DOCUMENTS

| | | | |
|---|---|---|---|
| 2317354 | 10/1974 | Germany | 96/69 |

OTHER PUBLICATIONS

V. A. Wente, "Manufacture of Superfine Organic Fibers", *Navy Research Lab.*, Washington, D.C., NRL Rpt. 4364 (111437), May 25, 1954, U.S. Dept. of Commerce, Office of Technical Services.

R. R. Butin, et al., "Melt Blowing–A One Step Web Process for New Nonwoven products", *Journal of the Tech. Assoc. of The Pulp and Paper Industry, V. 56, N.4, pp. 74–77, 1973.*

V. A. Wente, "Superfine Thermoplastic Fibers", *Industrial & Engin. Chem.*, V. 48, N. 8, pp. 1342–1346, 1956.

U. Kogelschatz, "Silent Discharges For The Generation of Ultra–violet and Vacuum Ultraviolet Excimer Radiation" *Pure and Appl. Chem.*, 62, No. 9, 1990, pp. 1667–1674.

(List continued on next page.)

*Primary Examiner*—Richard L. Chiesa
*Attorney, Agent, or Firm*—William E. Maycock

[57] ABSTRACT

A corona-assisted electrostatic filtration apparatus which includes a cathode, an anode filter element, and a means of establishing a nonalternating potential difference between the cathode and the anode which is sufficient to maintain a corona field of ionized gas between the cathode and the anode filter element. The anode filter element includes a porous fibrous sheet material having pores in a range of from about 0.1 to about 100 micrometers, with at least a portion of the fibers thereof being uniformly coated with a metal. Also provided is a method of utilizing such apparatus to remove particulate matter from a gaseous medium.

39 Claims, 5 Drawing Sheets

OTHER PUBLICATIONS

E. Eliasson, et al. "UV Excimer Radiation from Dielectric–Barrier Discharges" Appl. Phys. B. 46, pp. 299–303, 1988.

H. Esrom, et al., "Metal Deposition With A Windowless VUV Excimer Source", Applied Surface Science, pp. 1–5, 1991.

H. Esrom, et al., "Large Area Photochemical Dry Etching of of Polymers With Incoherent Excimer UV Radiation" *MRS Materials Research Soc.,* Fall Meeting, Dec. 2–6, 1991, Boston, MA.

H. Esrom, et al., "Excimer Laser–Induced Decomposition Of Aluminum Nitride", *MRS Materials Research Society, Fall Meeting,* Dec. 2–6, 1991, Boston, MA.

B. Eliasson, et al., "New Trends In High Intensity UV Generation" EPA Newsletter, No. 32, Mar. 1988, pp. 29–40.

U. Kogelschatz, "Silent–Discharge Driven Excimer UV Sources And Their Application", Appl. Surface Science, 54, 1992, pp. 410–423.

H. Esrom, et al., "UV Excimer Laser–Induced Pre–Nucleation Of Surfaces Followed By Electroless Metallization", *Chemtronics,* 1989, vol. 4, Sep., pp. 216–223.

U. Kogelschatz, et al., "New Incoherent Ultraviolet Excimer Sources For Photolytic Material Deposition", *Sonderdruck aus Laser Und Optoelektronik, Apr. 1990.*

H. Esrom, et al., "Investigation Of The Mechanism Of The UV–Induced Palladium Deposition Process From Thin solid Palladium Acetate Films", Appl. Surf. Science, 46, 1990, pp. 158–162.

H. Esrom, "Excimer Laser–Induced Surface Activation Of ALN For Electroless Metal Deposition", *Material Research Society Symp. Proc.,* vol. 204, 1991, pp. 457–465.

"New Excimer UV Sources For Industrial Applications", Asea Brown Boveri, Publication CH–E 3.30833.0 E, pp. 3–11, Mar., 1991.

J. Y. Zhang, et al., "UV–Induced Decomposition Of Absorbed CU–Acetylacetonate Films At Room Temperature For Electroless Metal Plating", Applied Surface Science, Jul. 1991, pp. 1–6.

H. Esrom, et al., "VUV Light–Induced Deposition Of Palladium Using An Incoherent $Xe_2$* Excimer Source", *Chemtronics,* 1989, vol. 4, Sep., pp. 202–208.

○ W/O CORONA, 20 L/MIN. ▽ WITH CORONA, 20 L/MIN.

○ W/O CORONA, 30 L/MIN. ▽ WITH CORONA, 30 L/MIN.

CORONA-ASSISTED ELECTROSTATIC FILTRATION APPARATUS AND METHOD

CROSS-REFERENCE TO RELATED APPLICATION

The copper-coated nonwoven web employed in the present invention can be made by the method described and claimed in copending and commonly assigned application Ser. No. 08/241,916, entitled METHOD OF COATING A SUBSTRATE WITH COPPER and filed of even date in the names of Ronald Sinclair Nohr and John Gavin MacDonald.

BACKGROUND OF THE INVENTION

The present invention relates to the removal of particulate matter present in a gaseous medium.

The filtration of air and other gaseous media has become increasingly important. For example, air filtration, however inefficient as it may be, is an integral part of every forced air home heating system. Air filtration also is employed in a number of industrial facilities, particularly those involving the manufacture of semiconductors, computer chips, and other electronic components. Air filtration is a necessity in medical clean rooms. In view of the wide-spread importance of gaseous filtration, there is an ongoing need for improved filtration apparatus and procedures, particularly those which reduce costs, improve filtration efficiency, or both.

SUMMARY OF THE INVENTION

Accordingly, the present invention provides a corona-assisted electrostatic filtration apparatus which includes:

a cathode;

an anode filter element located in functional proximity to the cathode and including a porous fibrous sheet material having pores in a range of from about 0.1 to about 100 micrometers, with at least a portion of the fibers thereof being coated with a metal; and a means of establishing a nonalternating potential difference between the cathode and the anode which is sufficient to maintain a corona field of ionized gas therebetween.

The present invention also provides a method of removing particulate matter from a gaseous medium which involves moving the gaseous medium sequentially past a cathode and through an anode filter element located in functional proximity to the cathode, with the cathode and anode filter element having a nonalternating potential difference established therebetween sufficient to maintain a corona field of ionized gas, in which the anode includes a porous fibrous sheet material having pores in a range of from about 0.1 to about 100 micrometers, with at least a portion of the fibers thereof being coated with a metal, under conditions sufficient to result in at least a portion of the particulate matter being retained by the anode filter element.

The present invention further provides an electrode pair assembly suitable for use in a corona-assisted electrostatic filtration apparatus which includes, in combination, a cathode and an anode filter element located in functional proximity to the cathode and including a porous fibrous sheet material having pores in a range of from about 0.1 to about 100 micrometers, with at least a portion of the fibers thereof being coated with a metal.

For example, the metal with which the fibers of the anode filter element are coated can be copper. As another example, the porous fibrous sheet material can be a nonwoven web.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DETAILED DESCRIPTION OF THE PREFERRED EMBODIMENT

Figure 1:
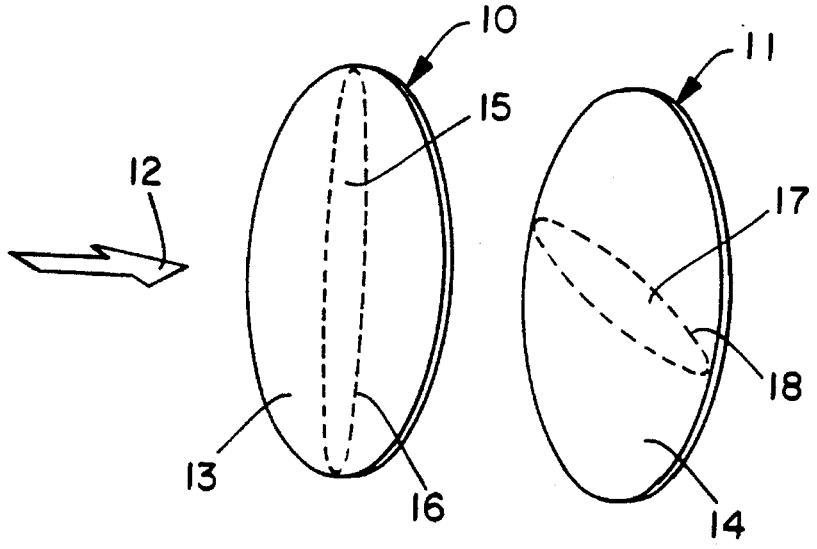
FIG. 1 is a diagrammatic representation of a characteristic of the apparatus and method of the present invention referred to as functional selectivity.

The present invention describes both a corona-assisted electrostatic filtration apparatus and a method of using the apparatus to remove particulate matter present in a gaseous medium. The particulate matter can be any particulate matter and the gaseous medium can be any nonflammable gaseous medium. As a practical matter, however, the gaseous medium will be air.

The corona-assisted electrostatic filtration apparatus of the present invention includes a cathode, an anode filter element located in functional proximity to the cathode, and a means of establishing a nonalternating potential difference between the cathode and the anode filter element which is sufficient to maintain a corona field of ionized gas therebetween. The means of establishing a nonalternating potential difference can be any means known to those having ordinary skill in the art. Such means typically will be a direct current generator or power supply. The term "nonalternating potential difference" means only that the cathode retains the same polarity or charge during the use of the apparatus, as does the anode filter element.

As used herein, the phrase "located in functional proximity to" means that the cathode and the anode filter element are sufficiently close to one another and are configured in a manner such that, upon maintaining a nonalternating potential difference therebetween, a corona field of ionized gas is generated. Moreover, the corona field is functional in that it is of an appropriate strength or intensity without substantial arcing (or "sparkover") or other undesirable effects.

The cathode can be any suitable size or shape, such as, by way of illustration only, a solid plate, a perforated plate, a wire mesh or screen, and a wire or plurality of wires. In certain embodiments, the cathode will be a wire or a plurality of wires.

The anode filter element includes a porous fibrous sheet material having pores in a range of from about 0.1 to about 100 micrometers, with at least a portion of the fibers thereof being uniformly coated with a metal. The term "pore" is used herein to mean a hole or passageway having a highly tortuous path or passageway. A hole or passageway which is generally linear will be referred to herein as an "aperture."

In general, the porous fibrous sheet material can be prepared from any fibrous material. Suitable fibrous materials include natural fibers or fibers prepared from synthetic materials. Natural fibers include, for example, cellulose and cellulose derivatives, wool, cotton, and the like. Synthetic materials include thermosetting and thermoplastic polymers. The term "polymer" is meant to include blends of two or more polymers and random and block copolymers prepared from two or more different starting materials or monomers.

Examples of thermosetting polymers include, by way of illustration only, alkyd resins, such as phthalic anhydride-glycerol resins, maleic acid-glycerol resins, adipic acid-glycerol resins, and phthalic anhydride-pentaerythritol resins; allylic resins, in which such monomers as diallyl phthalate, diallyl isophthalate diallyl maleate, and diallyl chlorendate serve as nonvolatile cross-linking agents in polyester compounds; amino resins, such as aniline-formaldehyde resins, ethylene urea-formaldehyde resins, dicyandiamide-formaldehyde resins, melamine-formaldehyde resins, sulfonamide-formaldehyde resins, and urea-formaldehyde resins; epoxy resins, such as cross-linked epichlorohydrin-bisphenol A resins; phenolic resins, such as phenol-formaldehyde resins, including Novolacs and resols; and thermosetting polyesters, silicones, and urethanes.

Examples of thermoplastic polymers include, by way of illustration only, end-capped polyacetals, such as poly(oxymethylene) or polyformaldehyde, poly(trichloroacetaldehyde), poly(n-valeraldehyde), poly(acetaldehyde), poly(propionaldehyde), and the like; acrylic polymers, such as polyacrylamide, poly(acrylic acid), poly(methacrylic acid), poly(ethyl acrylate), poly(methyl methacrylate), and the like; fluorocarbon polymers, such as poly(tetrafluoroethylene), perfluorinated ethylene-propylene copolymers, ethylene-tetrafluoroethylene copolymers, poly(chlorotrifluoroethylene), ethylene-chlorotrifluoroethylene copolymers, poly(vinylidene fluoride), poly(vinyl fluoride), and the like; polyamides, such as poly(6-aminocaproic acid) or poly(ε-caprolactam), poly(hexamethylene adipamide), poly(hexamethylene sebacamide), poly(11-amino-undecanoic acid), and the like; polyaramides, such as poly(imino-1,3-phenyleneiminoisophthaloyl) or poly(m-phenylene isophthalamide), and the like; parylenes, such as poly-p-xylylene, poly(chloro-p-xylylene), and the like; polyaryl ethers, such as poly(oxy-2,6-dimethyl-1,4-phenylene) or poly(p-phenylene oxide), and the like; polyaryl sulfones, such as poly(oxy-1,4-phenylenesulfonyl-1,4-phenyleneoxy-1,4-phenylene-isopropylidene-1,4-phenylene), poly(sulfonyl-1,4-phenyleneoxy-1,4-phenylenesulfonyl-4,4'-biphenylene), and the like; polycarbonates, such as poly(bisphenolA) orpoly(carbonyldioxy-1,4-phenyleneisopropylidene-1,4-phenylene), and the like; polyesters, such as poly(ethylene terephthalate), poly(tetramethylene terephthalate), poly(cyclohexylene-1,4-dimethylene terephthalate) or poly(oxymethylene-1,4-cyclohexylenemethyleneoxyterephthaloyl), and the like; polyaryl sulfides, such as poly(p-phenylene sulfide) or poly(thio-1,4-phenylene), and the like; polyimides, such as poly(pyromellitimido-1,4-phenylene), and the like; polyolefins, such as polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly(vinylidene chloride), polystyrene, and the like; copolymers of the foregoing, such as acrylonitrile-butadiene-styrene (ABS) copolymers, and the like; and the like.

In certain embodiments, the porous fibrous sheet material will be prepared from thermoplastic polymers. In other embodiments, the porous fibrous sheet material will be prepared from a polyolefin. In still other embodiments, the porous fibrous sheet material will be prepared from a polyolefin which contains only hydrogen and carbon atoms and which are prepared by the addition polymerization of one or more unsaturated monomers. Examples of such polyolefins include, among others, polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polystyrene, and the like.

In view of the suitable types of fibrous materials from which the porous fibrous sheet material may be prepared, such sheet material typically will be a nonwoven web. A nonwoven web in general can be prepared by any of the means known to those having ordinary skill in the art. For example, a nonwoven web can be prepared by such processes as meltblowing, coforming, spunbonding, hydroentangling, carding, air-laying, and wet-forming.

A nonwoven web more typically will be prepared by meltblowing, coforming, spunbonding, and the like. By way of illustration only, such processes are exemplified by the following references:

(a) meltblowing references include, by way of example, U.S. Pat. Nos. 3,016,599 to R. W. Perry, Jr., 3,704,198 to J. S. Prentice, 3,755,527 to J. P. Keller et al., 3,849,241 to R. R. Butin et al., 3,978,185 to R. R. Butin et al., and 4,663,220 to T. J. Wisneski et al. See, also, V. A. Wente, "Superfine Thermoplastic Fibers", *Industrial and Engineering Chemistry,* Vol. 48, No. 8, pp. 1342–1346 (1956); V. A. Wente et al., "Manufacture of Superfine Organic Fibers", Navy Research Laboratory, Washington, D.C., NRL Report 4364 (111437), dated May 25, 1954, United States Department of Commerce, Office of Technical Services; and Robert R. Butin and Dwight T. Lohkamp, "Melt Blowing—A One-Step Web Process for New Nonwoven Products", *Journal of the Technical Association of the Pulp and Paper Industry,* Vol. 56, No.4, pp. 74–77 (1973);

(b) coforming references include U.S. Pat. Nos. 4,100,324 to R. A. Anderson et al. and 4,118,531 to E. R. Hauser; and (c) spunbonding references include, among others, U.S. Pat. Nos. 3,341,394 to Kinney, 3,655,862 to Dorschner et al., 3,692,618 to Dorschner et al., 3,705,068 to Dobo et al., 3,802,817 to Matsuki et al., 3,853,651 to Porte, 4,064,605 to Akiyama et al., 4,091,140 to Harmon, 4,100,319 to Schwartz, 4,340,563 to Appel and Morman, 4,405,297 to Appel and Morman, 4,434,204 to Hartman et al., 4,627,811 to Greiser and Wagner, and 4,644,045 to Fowells.

At least a portion of the fibers of the porous fibrous sheet material are uniformly coated with a metal. For example, all of the fibers of the porous fibrous sheet material may be coated with a metal. As another example, only the fibers in selected or predetermined portions of the porous fibrous sheet material may be coated with a metal. Stated differently, it is not necessary that all of the fibers of which the porous fibrous sheet material is composed have a coating of a metal. When coated, however, the coating on a fiber will be uniform in the sense that the metal covers substantially all of the surface area of the fiber. Thus, each metal-coated fiber desirably exhibits little or no electrical resistance.

In general, any metal can be employed, provided it is both stable under the conditions of use of the anode filter element and it can be applied as a coating on fibers. Examples of the more suitable metals include the elements of Groups VIII and Ib in Periods 4 and 5 of the Periodic Table of the Elements. As a practical matter, the metal typically will be copper.

The fibers of the porous fibrous sheet material generally can be coated with a metal by any means known to those having ordinary skill in the art, provided, of course, that such means does not have a significantly detrimental effect on the porous fibrous sheet material. In general, the sheet material can be coated with a metal by an electroless procedure involving the use of a dielectric barrier discharge excimer lamp (also referred to hereinafter as "excimer lamp"). Such a lamp is described, for example, by U. Kogelschatz, "Silent discharges for the generation of ultraviolet and vacuum ultraviolet excimer radiation," *Pure & Appl. Chem.,* 62, No. 9, pp. 1667–1674 (1990); and E. Eliasson and U. Kogelschatz, "UV Excimer Radiation from Dielectric-Barrier Discharges," *Appl. Phys. B,* 46, pp. 299–303 (1988). Excimer lamps were developed by ABB Infocom Ltd., Lenzburg, Switzerland, and at the present time are available from Heraeus Noblelight GmbH, Kleinostheim, Germany.

The excimer lamp emits incoherent, pulsed ultraviolet radiation. Such radiation has a very narrow bandwidth, i.e., the half width is of the order of about 5–15 nm. This emitted radiation is incoherent and pulsed, the frequency of the pulses being dependent upon the frequency of the alternating current power supply which typically is in the range of from about 20 to about 300 kHz. An excimer lamp typically is identified or referred to by the wavelength at which the maximum intensity of the radiation occurs, which convention is followed throughout this specification and the claims. Thus, in comparison with most other commercially useful sources of ultraviolet radiation which typically emit over the entire ultraviolet spectrum and even into the visible region, excimer lamp radiation is essentially monochromatic.

Excimers are unstable molecular complexes which occur only under extreme conditions, such as those temporarily existing in special types of gas discharge. Typical examples are the molecular bonds between two rare gaseous atoms or between a rare gas atom and a halogen atom. Excimer complexes dissociate within less than a microsecond and, while they are dissociating, release their binding energy in the form of ultraviolet radiation. The dielectric barrier excimers in general emit in the range of from about 125 nm to about 500 nm, depending upon the excimer gas mixture.

A dielectric barrier discharge excimer lamp has been employed to form thin metal films on various substrates, such as ceramics (e.g., aluminum nitride and aluminum oxide), cardboard, glass, plastics (e.g., polyimide and teflon, and synthetic fibers. See, for example, H. Esrom and G. Wahl, *Chemtronics,* 4, 216–223 (1989); H. Esrom et al., *Chemtronics,* 4, 202–208 (1989); and Jun-Ying Zhang and Hilmar Esrom, *Appl. Surf. Sci.,* 54, 465–471 (1991). The procedure involved first preparing a solution of palladium acetate in chloroform, typically at a concentration of 0.25 g per 30 ml of solvent. The solution then was used to coat a substrate. The substrate was irradiated in a vacuum chamber with a $Xe_2$* excimer lamp emitting at a wavelength of 172 nanometers (nm), with or without a mask to prevent the radiation from reaching predetermined portions of the substrate. If a mask were used, the substrate was washed after irradiation. The irradiated substrate next was placed in an electroless solution, typically an electroless copper solution. After the desired amount of metal deposited from the bath onto the substrate, the substrate was removed from the solution, washed with water, and dried. The palladium acetate solution reportedly can be replaced with palladium or copper acetylacetonate.

A more simple, but equally effective, procedure is described in cross-referenced application Ser. No. 08/241,916. Briefly, a sample of a spunbonded polypropylene nonwoven web was placed in copper formate solution prepared by dissolving 5 g of copper formate (Aldrich Chemical Company, Milwaukee, Wis.), 0.5 ml of surfactant, and 1 g of gelatin (Kroger, colorless) in 100 ml of water. The surfactant was a polysiloxane polyether having the formula,

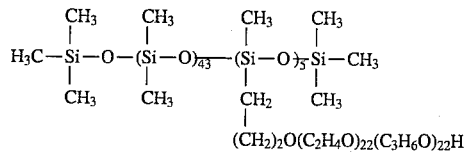

The material had a number-average molecular weight of about 7,700, a weight-average molecular weight of about 17,700, a z-average molecular weight of about 27,700, and a polydispersity of about 2.3.

The sample was soaked in the copper formate solution for 30 seconds, removed from the solution, and passed without folding through an Atlas Laboratory Wringer having a 5-lb (about 2.3-kg) nip setting (Atlas Electric Devices Company, Chicago, Ill.). Each side of the sample was exposed sequentially for three minutes in a vacuum chamber at 0.1 Torr to 172-nm excimer radiation. The sample then was washed with water and allowed to dry.

The fibers of the sample were coated with copper metal, yet retained the flexibility and hand of the original. The examination of individual fibers by a scanning electron microscope showed that each fiber was completely covered by a thin coating of copper; i.e., each fiber was uniformly covered with an approximately 60 Å thick coating of copper metal.

The porous fibrous sheet material in general will have pores in a range of from about 0.1 to about 100 micrometers. In certain embodiments, the porous fibrous sheet material will have pores in a range of from about 0.1 to about 50 micrometers. In other embodiments, the porous fibrous sheet material will have pores in a range of from about 0.1 to about 30 micrometers. When the porous fibrous sheet material is a nonwoven web, the pore size range is in part dependent upon the method of preparation. For example, spunbonding tends to produce larger-diameter fibers than does meltblowing. As a consequence, a spunbonded web tends to have larger pores than does a meltblown web. Thus, the pore size range can be controlled in part by the method used to prepare the nonwoven web, as well as by altering process conditions.

The versatility of such processes as spunbonding and meltblowing render them particularly well-suited for producing nonwoven webs useful in the present invention. Moreover, because the fibers produced by such process are laid down in a random manner, pathways through the resulting nonwoven webs are highly tortuous, especially in thicker webs. Thus, the efficiency or effectiveness of a nonwoven web employed as the anode filter element in retaining or entrapping particulate matter can be increased or controlled by increasing the thickness, or basis weight, of the web.

Efficiency and effectiveness in general are used interchangeably throughout this specification to refer to the amount of particulate matter retained by the anode filter element, expressed as a percent of the total amount of particulate matter to which the anode filter element is exposed, per unit amount of particulate matter retained by the anode filter element. An alternative term having the same meaning is "filtration efficiency."

Anode filter element efficiency also can be controlled through the use of a multilayered structure, at least one layer of which is a porous fibrous sheet material having pores in a range of from about 0.1 to about 100 micrometers, with at least a portion of the fibers thereof being uniformly coated with a metal. For example, the multilayered structure may include a spunbonded nonwoven web or a meltblown nonwoven web. In some embodiments, the multilayered structure advantageously will include both a spunbonded nonwoven web and a meltblown nonwoven web. In such case, the spunbonded nonwoven web typically will be located on the side of the multilayered structure which faces the cathode since a spunbonded nonwoven web typically has larger pores than does a meltblown nonwoven web. In fact, meltblown nonwoven webs commonly are composed of fibers having diameters in a range of from about 0.1 to about 10 micrometers; such fibers sometimes are referred to in the art as microfibers. Webs composed of microfibers generally have rather small pores, typically less than about 10 micrometers. Thus, the presence in the anode filter element of both a spunbonded nonwoven web and a meltblown nonwoven web helps to assure that particulate matter not captured or retained by the former will be retained by the latter.

In general, the generation of the corona field of ionized gas between the cathode and the anode filter element is accomplished in accordance with known procedures. The appropriate magnitude of the nonalternating potential difference between the two electrodes will be, in part, a function of the distance of the cathode from the anode filter element, the shape of the cathode, and the amount of water vapor present in the gaseous medium, among other factors, all of which are well understood by those having ordinary skill in the art.

One advantage of the present invention is the fact that the size, shape, and location of the cathode and the magnitude of the nonalternating potential difference (i.e., the cathode configuration and operating conditions) influence where the particulate matter contained in the gaseous medium impinges the anode filter element. By properly selecting the size, shape, and location of the cathode and the magnitude of the potential difference, particulate matter can be directed only to selected areas of the anode filter element, a phenomenon referred to hereinafter as functional selectivity. This leaves a portion of the anode filter element substantially free of particulate matter.

When a new or clean anode filter element is placed in the apparatus, a gaseous medium is able to flow through the element without obstruction. If pressure measurements are made before and after the element, the pressure readings will be essentially the same. Accordingly, there is no pressure drop on the downstream or exit side of the element and, as a consequence, there is no pressure differential. As particulate matter accumulates over time on or in the anode filter element, there is an increasing resistance to the flow of the gaseous medium through the element. This increasing resistance causes a continuous increase in pressure on the upstream or entrance side of the element and a concomitant continuous decrease in pressure on the downstream side. The result is a continually increasing pressure differential. Thus, the advantage described above lengthens the time during which the anode filter element can be used before the pressure differential becomes great enough to require changing or cleaning the anode filter element, compared with the same system without corona assistance.

The functional selectivity just described has an added benefit. By providing two or more apparatus, i.e., cathode-anode filter element pairs, in series, through which a gaseous medium must pass sequentially, increased efficiency is possible while maintaining low pressure differentials. By way of illustration only, a first apparatus can be provided, with the cathode configuration and operating conditions being selected to leave a portion of the first anode filter element essentially free of particulate matter. A second apparatus then can be provided, with the cathode configuration and operating conditions being selected to leave a portion of the second anode filter element essentially free of particulate matter. The portion of the first anode filter element which remains essentially free of particulate matter and the portion of the second anode filter element which remains essentially free of particulate matter are selected so they do not substantially coincide. This concept is illustrated by FIG. 1 which diagrammatically shows only the anode filter elements of two apparatus in series. FIG. 1 shows a first anode filter element 10 and a second anode filter element 11 in series, with the direction of flow of a gaseous medium indicated by the arrow 12. The first anode filter element 10 consists of a porous fibrous sheet material 13 and the second anode filter element 11 consists of a porous fibrous sheet material 14. The first anode filter element 10 has a portion 15, represented as the area enclosed by dashed line 16, which remains substantially free of particulate matter. Similarly, the second anode filter element 11 has a portion 17, represented as the area enclosed by dashed line 18, which remains substantially free of particulate matter. Portions 15 and 17 do not substantially coincide.

The same result can be accomplished by coating the fibers of the porous fibrous sheet material only in selected locations. The particulate matter will be directed preferentially only to those portions of the anode filter element the fibers of which have been coated with a metal. Referring again to FIG. 1, portions 15 and 17 also can represent areas of the anode filter elements 10 and 11, respectively, in which the fibers have not been coated with a metal.

Figure 2:
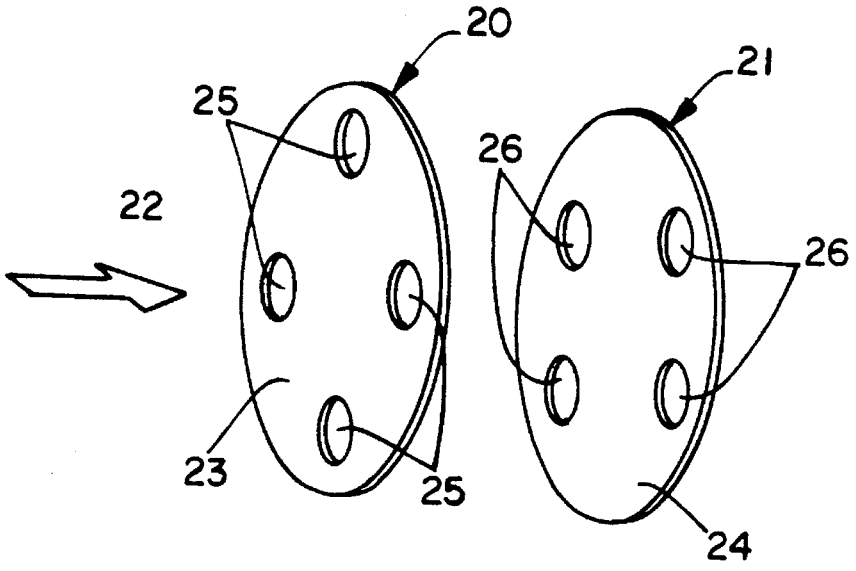
FIG. 2 is a diagrammatic representation of an embodiment which will achieve a result equivalent to that obtained by means of functional selectivity.

In a variation of the selective functionality described above, a similar result is possible without changing the cathode configuration or operating conditions. This embodiment is based on the configuration of the anode filter elements as shown diagrammatically in FIG. 2. FIG. 2 shows a first anode filter element 20 and a second anode filter element 21 in series, with the direction of flow of a gaseous medium indicated by the arrow 22. The first anode filter element 20 consists of a porous fibrous sheet material 23 and the second anode filter element 21 consists of a porous fibrous sheet material 24. The first anode filter element 20 has apertures 25 and the second anode filter element 21 has apertures 26. Apertures 25 and 26 do not substantially coincide.

The present invention is further described by the example which follows. Such example, however, is not to be construed as limiting in any way either the spirit or the scope of the present invention.

EXAMPLE

Equipment and Procedure

Figure 3:
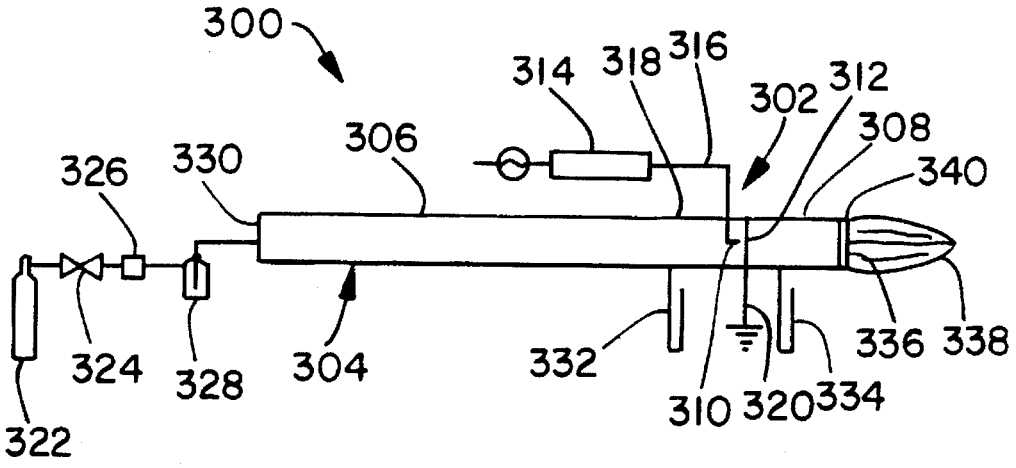
FIG. 3 is a diagrammatic representation of a model system, used in the example, which incorporates the apparatus of the present invention.

With reference to FIG. 3, a model system 300 was constructed which included the corona-assisted electrostatic filtration apparatus 302. The apparatus 302 was installed in a poly(methyl methacrylate) tube 304 having an inner diameter of about 3 cm. and made in two sections, 306 and 308. The section 306 was roughly 90 cm long and the section 308 was about 15 cm in length. The apparatus 302 consisted of a cathode 310, an anode filter element 312, and a high voltage, direct current power supply 314. The cathode 310 consisted of a solid copper wire 316 which was connected to a power supply 314 and had a diameter of about 1 mm. The wire 316 entered the section 306 of the tube 304 perpendicular to the wall 318 of the section 306. The portion of the wire 316 within the tube terminating in the cathode 310 had at the cross-sectional center of the section 306 a 90° bend, directing the cathode 310 toward the center of the anode filter element 312. The end of the cathode 310 was about 6 cm from the anode filter element 312. The distance from the end of the cathode 310 to the 90° bend of the wire 316 was about 5 cm.

The anode filter element 312 consisted of a single layer of a spunbonded polypropylene nonwoven web prepared on pilot scale equipment essentially as described in U.S. Pat. No. 4,360,563. The web was thermally point-bonded and had a basis weight of 1 ounce per square yard (about 24 grams per square meter). The fibers of the nonwoven web were coated with copper metal.

The procedure employed to coat the fibers of the spunbonded nonwoven web with copper was that of Esrom et al., described earlier, and involved first cutting the web into 8 cm×15 cm samples without touching them in order to avoid depositing body oils on the fibers. A palladium(II) acetate solution was prepared by dissolving the salt in chloroform at a concentration of 0.25 g per 30 ml of solvent. A sample of the nonwoven web was placed in a beaker of a size such that the fabric was laying flat on the bottom of the beaker. The sample was carefully covered with 100 ml of the palladium(II) acetate solution. The sample was withdrawn from the solution carefully with tweezers and the solvent was allowed to evaporate while turning the sample several times to keep the solution as uniformly distributed on the web as possible. Each side of the sample was exposed sequentially for five minutes in a vacuum chamber at 0.1 Torr to 172-nm excimer radiation from a $Xe_2$* excimer lamp assembly. The distance from the lamps to the sample was about 2.5 cm. The power density of each lamp was about 500 watts per square meter (about 1,000 watts per pair of lamps having lengths of 30 cm).

Figure 4:
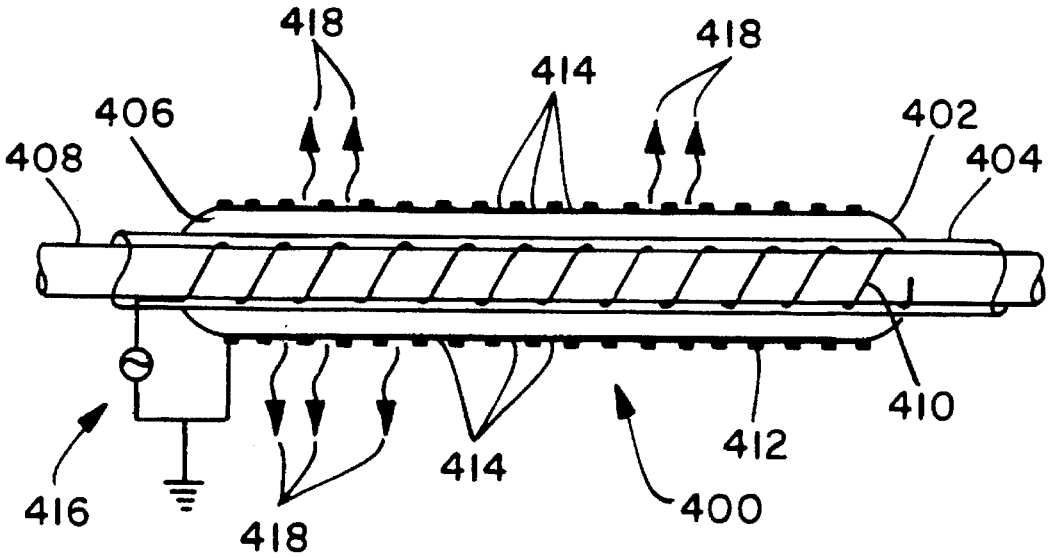
FIG. 4 is a diagrammatic representation of the excimer lamp employed in the example.

The excimer lamp was configured substantially as described by Kogelschatz and Eliasson et al., supra, and is shown diagrammatically in FIG. 4. With reference to FIG. 4, the excimer lamp 400 consisted of three coaxial quartz cylinders and two coaxial electrodes. The outer coaxial quartz cylinder 402 was fused at the ends thereof to a central coaxial quartz cylinder 404 to form an annular discharge space 406. An excimer-forming gas mixture was enclosed in annular discharge space 406. An inner coaxial quartz cylinder 408 was placed within the central cylinder 404. The inner coaxial electrode 410 consisted of a wire wound around the inner cylinder 408. The outer coaxial electrode 412 consisted of a wire mesh having a plurality of openings 414. The inner coaxial electrode 410 and outer coaxial electrode 412 were connected to a high voltage generator 416. Electrical discharge was maintained by applying an alternating high voltage to the coaxial electrodes 410 and 412. The operating frequency was 40 kHz, the operating voltage 10 kV. Cooling water was passed through the inner coaxial quartz cylinder 408, thereby maintaining the temperature at the outer surface of the lamp at less than about 120° C.. The resulting ultraviolet radiation was emitted through openings 414 as shown by lines 418. The lamp was used as an assembly of four lamps 400 mounted side-by-side in a parallel arrangement.

The sample of nonwoven web then was placed in a clean beaker of the same size used previously. An electroless copper bath (Cuposit CP-78, Shipley GmbH, Stuttgart, Germany) at ambient temperature was applied to both sides of the sample, following the manufacturer's instructions for the preparation of the bath. The total volume of bath employed was about 500 ml. The application procedure required carefully turning the sample over several times with tweezers. The total time of exposure of each sample to the electroless copper bath typically was from about 30 seconds to about 1 minute. The sample then was removed from the bath, rinsed thoroughly with water, and dried in a vacuum oven.

Returning to FIG. 3, circular portions of the copper-coated nonwoven web samples were cut out, such that such portions had a diameter slightly larger than the outer diameter of tube 304. A single circular portion became an anode filter element 312 by simply placing the portion between sections 306 and 308 of the tube 304 and clamping the two sections together (clamp not shown). A ground wire 320 was attached to each newly installed anode filter element 312 by means of an alligator clamp (not shown).

Air was supplied from a cylinder 322, passing through a control valve 324 into a calibrated particle feeder 326 (Wright Particle Feeder, L. Adams Ltd., London, England) which was used to seed the entire gas flow with titanium dioxide powder (Fisher Scientific Company, Pittsburgh, Pa.) having particle diameters of about one micrometer. Because the lowest feed rate of the feeder 326 was too high, an Erlenmeyer flask 328 was used to reduce the powder concentration entering the tube 304. The air flow rates employed, 20 liters per minute and 30 liters per minute, were not sufficiently high to keep all of the titanium dioxide suspended; thus, excess powder simply settled by gravity in the flask 328. Air containing the titanium dioxide particles exited the flask 328 and entered the tube 304 at the end 330. The length of the section 306 of the tube 304 was selected to reduce the turbulence of the air as it entered the tube 304 and to allow the air movement toward the apparatus 302 to approach laminar flow conditions.

As the air approached the apparatus 302, a pressure reading was taken by means of a manometer 332. The air moved past the cathode 310 and through the anode filter element 312. Another pressure reading was taken by the manometer 334 after the air had passed through the anode filter element 312. The air then exited the tube 304 through the end 336 into a high efficiency filter 338 attached to the section 308 by a clamp 340 to collect any titanium dioxide powder not retained by the anode filter element 312.

The efficiency of the anode filter element 312 in capturing or retaining titanium dioxide powder was determined by weighing each anode filter element before installing it in the filtration system 300. The filter 338 also was weighed before each experiment. The percent of powder captured was calculated as 100 times the quotient of weight gained by the anode filter element 312 divided by the sum of the weight gained by the anode filter element 312 and the filter 338.

An air flow rate of 20 liters per minute gave a linear air velocity through the anode filter element of 0.47 meter per second. The titanium dioxide powder loading varied from 5–600 mg/m$^3$, a range which is typical in domestic applications.

Experiments first were done with the power off, i.e., without a corona field, to determine a baseline. Experiments then were conducted with power on at 8,400 volts, which was the highest voltage which gave minimal sparkover. At 8,400 volts, the corona current varied from 13 to 42 milliamps (mA). The current varied slightly during each experiment but exhibited no specific trend. The difference in current from experiment to experiment probably was due to slightly different distances between the corona wire and the filter.

Experimental Results

The results of a number of experiments at air flow rates of 20 and 30 liters per minute are summarized in Tables 1 to 4. In the tables, "Exp" represents the experiment number; "Total Powder Concn." is the concentration of the titanium dioxide powder in the air being passed through the system, in mg per cubic meter; "AFE Weight" is the weight in mg of titanium dioxide retained or captured by the anode filter element; "AFE Powder Concn." is the amount of titanium dioxide powder retained or captured by the anode filter element, expressed as a concentration in mg per cubic meter; "PD (Pa)" is the pressure drop or difference in pressure readings of the manometers 332 and 334, in Pascals; and "Percent Calculated" is the amount of the powder retained by the anode filter element, calculated as already described.

TABLE 1

Summary of Individual Experiments with No Corona Field and An Air Flow Rate of 20 Liters per Minute

| Exp | Total Powder Concn. | Time (Min.) | AFE Weight (mg) | AFE Powder Concn. | PD (Pa) | Percent Captured |
|---|---|---|---|---|---|---|
| 10 | 68.6 | 21 | 23.9 | 56.9 | 922 | 83.0 |
| 11 | 50.4 | 14 | 9.1 | 32.5 | 98 | 64.5 |
| 12 | 143.4 | 6 | 10.6 | 87.5 | 196 | 61.0 |
| 13 | 84.3 | 20 | 26.2 | 65.5 | 1118 | 77.7 |
| 14 | 58.9 | 32 | 29.7 | 46.4 | 1118 | 78.8 |
| 15 | 21.7 | 20 | 4.0 | 10.0 | 39 | 46.0 |
| 16 | 28.0 | 25 | 8.5 | 17.0 | 59 | 60.7 |
| 17 | 22.8 | 20 | 6.1 | 15.3 | 39 | 67.0 |

TABLE 2

Summary of Individual Experiments with 8,400-Volt Corona Field and An Air Flow Rate of 20 Liters per Minute

| Exp | Current (mA) | Total Powder Concn. | Time (Min.) | AFE Weight (mg) | AFE Powder Concn. | PD (Pa) | Percent Captured |
|---|---|---|---|---|---|---|---|
| 1 | 14 | 87.5 | 4 | 5.0 | 62.5 | 39 | 71.4 |
| 2 | 42 | 38.6 | 18 | 10.9 | 30.3 | 39 | 78.4 |
| 3 | 30 | 175.1 | 6 | 15.4 | 128.3 | 196 | 73.3 |
| 4 | 29 | 93.3 | 12 | 15.9 | 66.3 | 98 | 71.0 |
| 5 | 42 | 45.4 | 25 | 29.6 | 39.2 | 59 | 86.3 |
| 6 | 20 | 582.6 | 4 | 41.9 | 523.8 | 373 | 89.9 |
| 7 | 15 | 7.5 | 20 | 1.9 | 4.8 | 10 | 63.3 |
| 8 | 17 | 80.0 | 8 | 8.7 | 54.4 | 10 | 68.0 |
| 9 | 17 | 13.3 | 20 | 3.7 | 9.3 | 10 | 69.8 |

TABLE 3

Summary of Individual Experiments with No Corona Field and An Air Flow Rate of 30 Liters per Minute[a]

| Exp | Total Powder Concn. | Time (Min.) | AFE Weight (mg) | AFE Powder Concn. | PD (Pa) | Percent Captured |
|---|---|---|---|---|---|---|
| 20 | 39.0 | 20 | 15.7 | 26.2 | 275 | 67.1 |
| 21 | 69.2 | 8 | 10.1 | 42.1 | 177 | 60.8 |
| 22 | 243.2 | 2 | 8.1 | 135.0 | 118 | 55.5 |
| 26 | 61.7 | 6 | 6.6 | 36.6 | 98 | 59.4 |

[a]Two experiments were not included because the nature of the titanium dioxide powder appeared to differ from that of the other experiments.

TABLE 4

Summary of Individual Experiments with 8,400-Volt Corona Field and An Air Flow Rate of 30 Liters per Minute[b]

| Exp | Current (mA) | Total Powder Concn. | Time (Min.) | AFE Weight (mg) | AFE Powder Concn. | PD (Pa) | Percent Captured |
|---|---|---|---|---|---|---|---|
| 18 | 21 | 63.3 | 6 | 9.7 | 40.4 | 59 | 63.8 |
| 19 | 14 | 59.7 | 8 | 12.1 | 40.3 | 118 | 67.6 |

TABLE 4-continued

| Summary of Individual Experiments with 8,400-Volt Corona Field and An Air Flow Rate of 30 Liters per Minute[b] | | | | | | | |
|---|---|---|---|---|---|---|---|
| Exp | Current (mA) | Total Powder Concn. | Time (Min.) | AFE Weight (mg) | AFE Powder Concn. | PD (Pa) | Percent Captured |
| 25 | 13 | 68.3 | 8 | 6.7 | 37.2 | 78 | 54.5 |

[b]One experiment which employed an insulated cathode wire was not included; the insulation altered the characteristics of the corona field.

Figure 5:
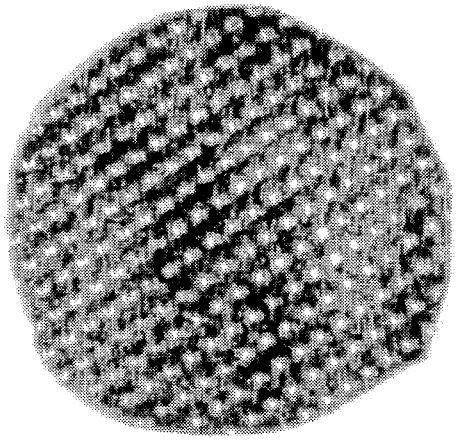
FIG. 5 is a color photograph of the anode filter element employed in the examples, before use.
Figure 6:
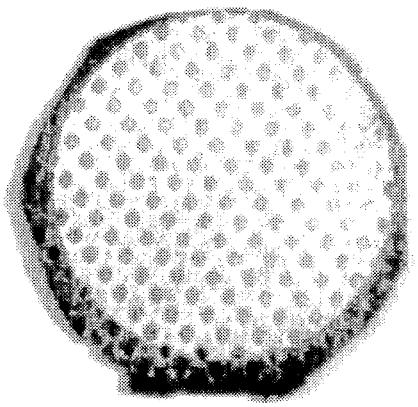
FIGS. 6–8 are color photographs of anode filter elements employed in three experiments described in the example, after use.
Figure 7:
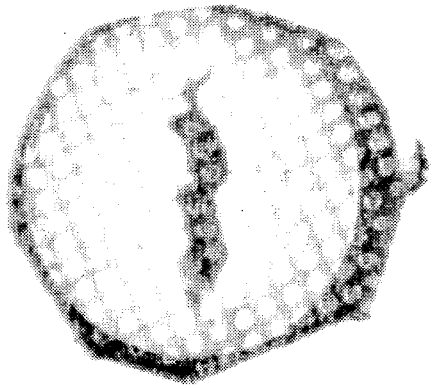
Figure 8:
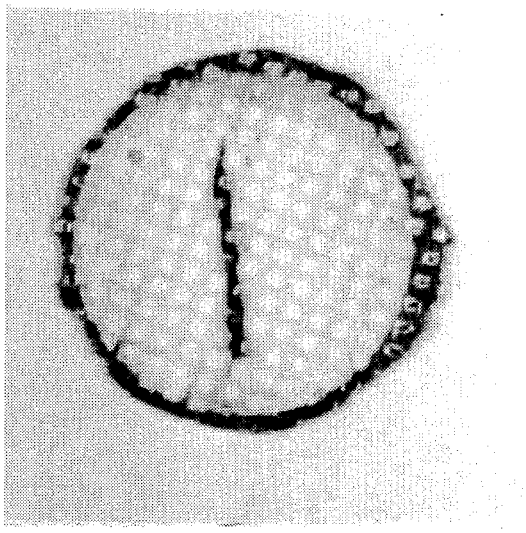

The functional selectivity of the apparatus and method of the present invention is shown in FIGS. 5–8. FIG. 5 is a color photograph of an anode filter element employed in the example, prior to use. FIG. 6 is a color photograph of the anode filter element at the end of Experiment 13 (Table 1). FIGS. 7 and 8 are color photographs of the anode filter elements at the end of Experiments 2 and 3, respectively (Table 2). FIGS. 7 and 8 illustrate the phenomenon of functional selectivity, in that particulate matter collected on most of the surface of the element, except for a roughly oval vertical central portion. Such phenomenon is the reason why Experiments 2 and 3 exhibited pressure drops of 39 and 196 Pascals, respectively, whereas Experiment 13 exhibited a pressure drop of 1118 Pascals.

The data presented in Tables 1–4 involve three variables: (1) the presence or absence of a corona field, (2) the concentration of titanium dioxide powder in the air stream, and (3) the duration or time of each experiment. Thus, the percent of powder captured by the anode is a function of those three variables. Consequently, an analysis of the data is required in order to fully appreciate the effect of the present invention on filtration efficiency.

The filtration efficiency (FE) for each experiment included in Tables 1–4, inclusive, was calculated by dividing the percent captured value by the amount of titanium dioxide powder, in mg, retained by the anode filter element. The results are summarized in Table 5.

TABLE 5

| Calculated Filtration Efficiencies | | | | | | | |
|---|---|---|---|---|---|---|---|
| 20 L/Min. Air Flow Rate | | | | 30 L/Min. Air Flow Rate | | | |
| W/O Corona | | With Corona | | W/O Corona | | With Corona | |
| Exp | FE | Exp | FE | Exp | FE | Exp | FE |
| 10 | 3.47 | 1 | 14.3 | 20 | 4.27 | 18 | 6.58 |
| 11 | 7.09 | 2 | 7.19 | 21 | 6.02 | 19 | 5.59 |
| 12 | 5.75 | 3 | 4.76 | 22 | 6.85 | 25 | 8.13 |
| 13 | 2.97 | 4 | 4.47 | 26 | 9.00 | Ave. | 6.77 |
| 14 | 2.75 | 5 | 4.40 | Ave. | 6.54 | | |
| 15 | 11.5 | 6 | 2.15 | | | | |
| 16 | 7.14 | 7 | 33.3 | | | | |
| 17 | 11.0 | 8 | 7.93 | | | | |
| Ave. | 6.46 | 9 | 18.9 | | | | |
| | | Ave. | 10.8 | | | | |

With an air flow rate of 20 liters per minute, the use of corona resulted in an approximately 67 percent improvement, based on the average filtration efficiency values. At an air flow rate of 30 liters per minute, the improvement in average filtration efficiency was approximately 4 percent.

Figure 9:
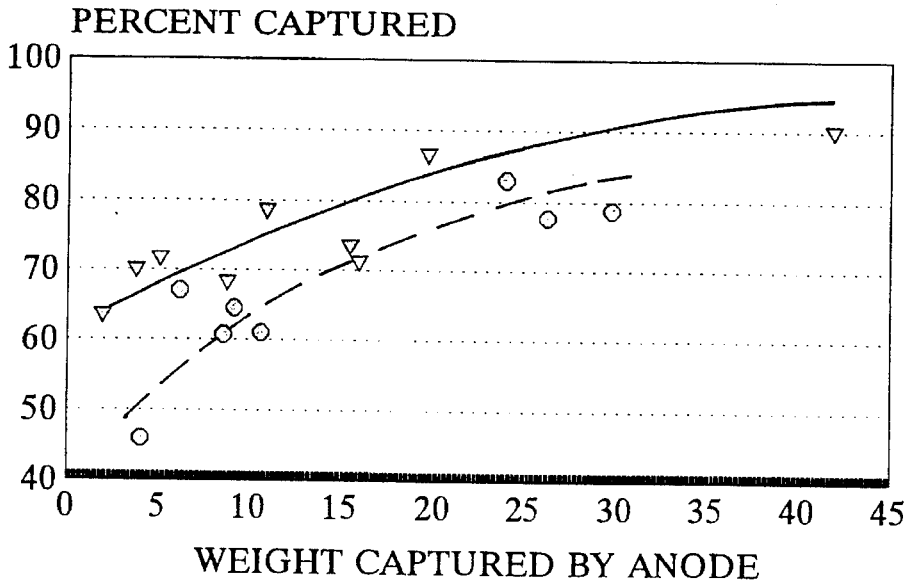
FIGS. 9 and 10 are plots of the weight of particulate matter captured by an anode filter element of the present invention versus the percent of particulate matter captured, at air flow rates of 20 liters per minute and 30 liters minute, respectively.

In accordance with standard practice in the filtration art, the amount of powder captured by the anode filter element, in mg, was plotted versus the percent of powder captured by the anode filter element, first without a corona field and then with a corona field, both with an air flow rate of 20 liters per minute (data from Tables 1 and 2, respectively). In each case, the best fitting curve was estimated and drawn manually. The plots are shown in FIG. 9; the plot without corona is a dashed line and the plot with corona is a solid line. Similar plots were prepared for an air flow rate of 30 liters per minute and are shown in FIG. 10 (data from Tables 3 and 4, respectively).

Figure 10:
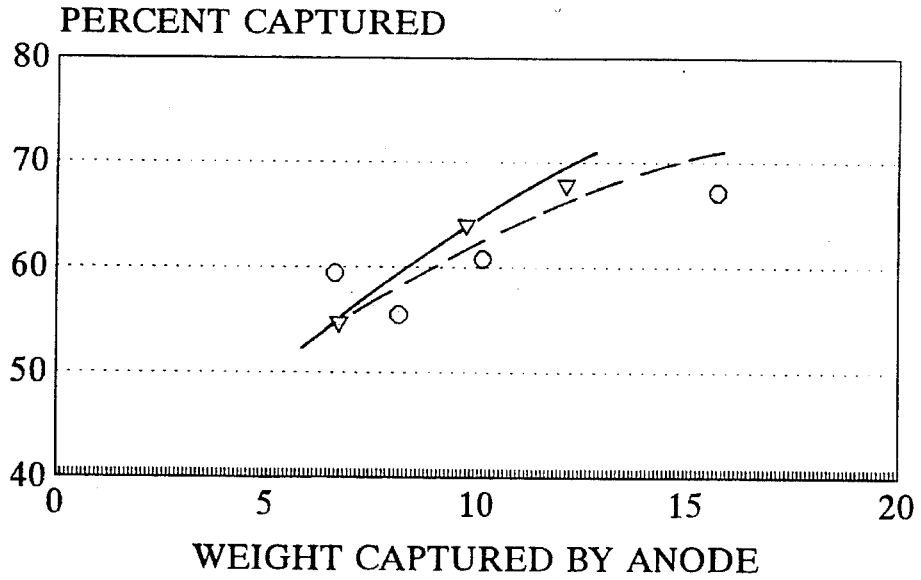

The calculations shown in Table 5, together with FIGS. 9 and 10, clearly show the improvement in filtration efficiency. It is evident that the use of a corona field was more effective at the lower air flow rate. Because corona drift velocities tend to be quite low, the higher air flow rate tended to negate the effect of the corona field. It also is apparent that filtration efficiency improves with increasing accumulations of particulate matter on the anode filter element.

A dramatic decrease in pressure drop resulting from the use of a corona field in accordance with the present invention also is evident from Tables 1–4, inclusive. At an air flow rate of 20 liters per minute, the average pressure drops without and with corona are 449 Pa and 93 Pa, respectively, a reduction of almost 80 percent. At an air flow rate of 30 liters per minute, the average pressure drops without and with corona are 167 Pa and 85 Pa, respectively, a reduction of almost 50 percent.

In order to better understand the relationship of pressure drop to anode filter element loading, the pressure drop for each experiment was plotted versus the actual amount of titanium dioxide powder captured by the anode filter element, first without corona and then with corona, both at an air flow rate of 20 liters per minute (data from Tables 1 and 2, respectively). In each case, the best fitting curve was estimated and drawn manually. The plots are shown in FIG. 11. As with FIGS. 9 and 10, the plot without corona is a dashed line and the plot with corona is a solid line. Similar plots were prepared for an air flow rate of 30 liters per minute and are shown in FIG. 12 (data from Tables 3 and 4, respectively).

At an air flow rate of 20 liters per minute, the differences in the effect of filter element loading on pressure drop are remarkable. When a corona field was not present, the pressure drop rose relatively slowly, perhaps even linearly, until a loading of about 8 mg was reached. Pressure drop then increased rapidly with increased loadings and appears to be approaching a maximum pressure drop at an anode filter element loading of about 30 mg. With a corona field, however, the pressure drop rose far more slowly with increasing anode filter element loadings. Moreover, at an anode filter element loading over 40 mg, the pressure drop with corona was roughly equivalent to a loading without corona of about 15 mg. When the air flow rate was increased to 30 liters per minute, the pressure drop appeared to increase linearly with increased anode filter element loading, both without and with corona. However, the pressure drop increased more rapidly without corona than with it.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A corona-assisted electrostatic filtration apparatus for the removal of particulate matter from a gaseous medium, the apparatus comprising:

a cathode having a size, shape, and location;

an anode filter element located in functional proximity to the cathode and comprising a porous fibrous sheet material defining pores in a range of from about 0.1 to about 100 micrometers, with at least a portion of the fibers thereof being uniformly coated with a nonparticulate, elemental metal; and a means of establishing between the cathode and the anode filter element a nonalternating potential difference having a magnitude which is sufficient to maintain a corona field of ionized gas therebetween;

in which the size, shape, and location of the cathode and the magnitude of the potential difference are selected to direct the particulate matter only to selected areas of the anode filter element, such that a portion of the anode filter element remains substantially free of particulate matter.

2. The apparatus of claim 1, in which the metal is copper.

3. The apparatus of claim 1, in which the porous fibrous sheet material is a nonwoven web.

4. The apparatus of claim 1, in which the porous fibrous sheet material is a layer in a multilayered anode filter element.

5. The apparatus of claim 1, which includes a means of moving a gaseous medium sequentially past the cathode and through the anode filter element.

6. A corona-assisted electrostatic filtration apparatus for the removal of particulate matter from a gaseous medium, the apparatus comprising:

a first cathode-anode filter element pair; and a second cathode-anode filter element pair;

in which each of the first and second cathode-anode filter element pairs comprises:

a cathode having a size, shape, and location;

an anode filter element located in functional proximity to the cathode and comprising a porous fibrous sheet material defining pores in a range of from about 0.1 to about 100 micrometers, with at least a portion of the fibers thereof being uniformly coated with a nonparticulate, elemental metal; and a means of establishing between the cathode and the anode filter element a nonalternating potential difference having a magnitude which is sufficient to maintain a corona field of ionized gas therebetween;

in which for each cathode-anode filter element pair, the size, shape, and location of the cathode and the magnitude of the potential difference are selected to direct the particulate matter only to selected areas of the anode filter element thereof, such that a portion of the anode filter element remains substantially free of particulate matter; and the portion of the anode filter element of the first cathode-anode filter element pair which remains substantially free of particulate matter and the portion of the anode filter element of the second cathode-anode filter element pair which remains substantially free of particulate matter do not substantially coincide.

7. The apparatus of claim 6, in which the metal with which at least a portion of the fibrous sheet material comprising each of the first and second anode filter elements is coated is copper.

8. The apparatus of claim 6, in which at least one of the porous fibrous sheet materials comprising the first and second anode filter elements is a nonwoven web.

9. The apparatus of claim 6, in which at least one of the porous fibrous sheet materials comprising the first and second anode filter elements is a layer in a multilayered anode filter element.

10. The apparatus of claim 6, which includes a means of moving a gaseous medium sequentially past the cathode and through the anode filter element of each cathode-anode filter element pair.

11. A corona-assisted electrostatic filtration apparatus for the removal of particulate matter from a gaseous medium, the apparatus comprising:

a first cathode-anode filter element pair; and a second cathode-anode filter element pair;

in which each of the first and second cathode-anode filter element pairs comprises:

a cathode;

an anode filter element located in functional proximity to the cathode and comprising a porous fibrous sheet material defining pores in a range of from about 0.1 to about 100 micrometers, with a portion of the fibers thereof being uniformly coated with a nonparticulate, elemental metal and a portion of the fibers thereof not being coated with a metal; and a means of establishing between the cathode and the anode filter element a nonalternating potential difference which is sufficient to maintain a corona field of ionized gas therebetween;

in which the portion of the anode filter element of the first cathode-anode filter element pair having fibers not coated with a metal and the portion of the anode filter element of the second cathode-anode filter element pair having fibers not coated with a metal do not substantially coincide.

12. The apparatus of claim 11, in which the metal with which a portion of the fibers of the porous fibrous sheet material comprising the anode filter elements of the first and second cathode-anode filter element pairs is coated is copper.

13. The apparatus of claim 11, in which the porous fibrous sheet material comprising the anode filter element of the first and second cathode-anode filter element pairs is a nonwoven web.

14. The apparatus of claim 11, in which the porous fibrous sheet material is a layer in a multilayered anode filter element.

15. The apparatus of claim 11, which includes a means of moving a gaseous medium sequentially past the cathode and through the anode filter element of each cathode-anode filter element pair.

16. A corona-assisted electrostatic filtration apparatus for the removal of particulate matter from a gaseous medium, the apparatus comprising:

a first cathode-anode filter element pair; and a second cathode-anode filter element pair;

in which each of the first and second cathode-anode filter element pairs comprises:

a cathode;

an anode filter element located in functional proximity to the cathode and comprising a porous fibrous sheet material defining pores in a range of from about 0.1 to about 100 micrometers and having at least one aperture therethrough, with at least a portion of the fibers thereof being uniformly coated with a nonparticulate, elemental metal; and a means of establishing between the cathode and the anode filter element a nonalternating potential difference having a magnitude which is sufficient to maintain a corona field of ionized gas therebetween;

in which the apertures in the anode filter element of the first cathode-anode filter element pair and the apertures in the anode filter element of the second cathode-anode filter element pair do not substantially coincide.

17. The apparatus of claim 16, in which the metal with which at least a portion of the fibrous sheet material comprising each of the first and second anode filter elements is coated is copper.

18. The apparatus of claim 16, in which at least one of the porous fibrous sheet materials comprising the first and second anode filter elements is a nonwoven web.

19. The apparatus of claim 16, in which at least one of the porous fibrous sheet materials comprising the first and second anode filter elements is a layer in a multilayered anode filter element.

20. The apparatus of claim 16, which includes a means of moving a gaseous medium sequentially past the cathode and through the anode filter element of each cathode-anode filter element pair.

21. A method of removing particulate matter from a gaseous medium which comprises:

moving the gaseous medium sequentially past a cathode and through an anode filter element; and establishing between the cathode and the anode filter element a nonalternating potential difference having a magnitude which is sufficient to maintain a corona field of ionized gas therebetween;

in which:

the cathode has a size, shape and location;

the anode filter element is located in functional proximity to the cathode;

the anode filter element comprises a porous fibrous sheet material defining pores in a range of from about 0.1 to about 100 micrometers, with at least a portion of the fibers thereof being uniformly coated with a nonparticulate, elemental metal; and the size, shape, and location of the cathode and the magnitude of the potential difference are selected to direct the particulate matter only to selected areas of the anode filter element, such that a portion of the anode filter element remains substantially free of particulate matter.

22. The method of claim 21, in which the metal is copper.

23. The method of claim 21, in which the porous fibrous sheet material is a nonwoven web.

24. The method of claim 21, in which the porous fibrous sheet material is a layer in a multilayered anode filter element.

25. A method of removing particulate matter from a gaseous medium which comprises:

moving the gaseous medium sequentially past a cathode and through an anode filter element of a first cathode-anode filter element pair and sequentially past a cathode and through an anode filter element of a second cathode-anode filter element pair; and establishing between the cathode and the anode filter element of each cathode-anode filter element pair a nonalternating potential difference having a magnitude which is sufficient to maintain a corona field of ionized gas therebetween;

in which the cathode of each cathode-anode filter element pair has a size, shape and location;

the anode filter element of each cathode-anode filter element pair is located in functional proximity to the cathode of each pair and comprises a porous fibrous sheet material defining pores in a range of from about 0.1 to about 100 micrometers, with at least a portion of the fibers thereof being uniformly coated with a nonparticulate, elemental metal;

for each cathode-anode filter element pair, the size, shape, and location of the cathode and the magnitude of the potential difference are selected to direct the particulate matter only to selected areas of the anode filter element, such that a portion of the anode filter element remains substantially free of particulate matter; and the portion of the anode filter element of the first cathode-anode filter element pair which remains substantially free of particulate matter and the portion of the anode filter element of the second cathode-anode filter element pair which remains substantially free of particulate matter do not substantially coincide.

26. The method of claim 25, in which the metal with which at least a portion of the fibrous sheet material comprising each of the first and second anode filter elements is coated is copper.

27. The method of claim 25, in which at least one of the porous fibrous sheet materials comprising the first and second anode filter elements is a nonwoven web.

28. The method of claim 25, in which at least one of the porous fibrous sheet materials comprising the first and second anode filter elements is a layer in a multilayered anode filter element.

29. The method of claim 25, which includes a means of moving a gaseous medium sequentially past the cathode and through the anode filter element of each cathode-anode filter element pair.

30. A method of removing particulate matter from a gaseous medium which comprises:

moving the gaseous medium sequentially past a cathode and through an anode filter element of a first cathode-anode filter element pair and sequentially past a cathode and through an anode filter element of a second cathode-anode filter element pair; and establishing between the cathode and the anode filter element of each cathode-anode filter element pair a nonalternating potential difference having a magnitude which is sufficient to maintain a corona field of ionized gas therebetween;

in which the anode filter element of each cathode-anode filter element pair is located in functional proximity to the cathode of each pair and comprises a porous fibrous sheet material defining pores in a range of from about 0.1 to about 100 micrometers, with a portion of the fibers thereof being uniformly coated with a nonparticulate, elemental metal and a portion of the fibers thereof not being coated with a metal; and the portion of the anode filter element of the first cathode-anode filter element pair having fibers not coated with a metal and the portion of the anode filter element of the second cathode-anode filter element pair having fibers not coated with a metal do not substantially coincide.

31. The method of claim 30, in which the metal with which a portion of the fibers of the porous fibrous sheet material comprising the anode filter elements of the first and second cathode-anode filter element pairs is coated is copper.

32. The method of claim 30, in which the porous fibrous sheet material comprising the anode filter element of the first and second cathode-anode filter element pairs is a nonwoven web.

33. The method of claim 30, in which the porous fibrous sheet material is a layer in a multilayered anode filter element.

34. The method of claim 30, which includes a means of moving a gaseous medium sequentially past the cathode and through the anode filter element of each cathode-anode filter element pair.

35. A method of removing particulate matter from a gaseous medium which comprises:

moving the gaseous medium sequentially past a cathode and through an anode filter element of a first cathode-anode filter element pair and sequentially past a cathode and through an anode filter element of a second cathode-anode filter element pair; and establishing between the cathode and the anode filter element of each cathode-anode filter element pair a nonalternating potential difference having a magnitude which is sufficient to maintain a corona field of ionized gas;

in which the anode filter element of each cathode-anode filter element pair is located in functional proximity to the cathode of each pair and comprises a porous fibrous sheet material defining pores in a range of from about 0.1 to about 100 micrometers and having at least one aperture therethrough, with at least a portion of the fibers thereof being uniformly coated with a nonparticulate, elemental metal; and the apertures in the anode filter element of the first cathode-anode filter element pair and the apertures in the anode filter element of the second cathode-anode filter element pair do not substantially coincide.

36. The method of claim 35, in which the metal with which at least a portion of the fibrous sheet material comprising each of the first and second anode filter elements is coated is copper.

37. The method of claim 35, in which at least one of the porous fibrous sheet materials comprising the first and second anode filter elements is a nonwoven web.

38. The method of claim 35, in which at least one of the porous fibrous sheet materials comprising the first and second anode filter elements is a layer in a multilayered anode filter element.

39. The method of claim 35, which includes a means of moving a gaseous medium sequentially past the cathode and through the anode filter element of each cathode-anode filter element pair.

* * * * *